United States Patent [19]

Cuir et al.

[11] Patent Number: 4,573,677

[45] Date of Patent: Mar. 4, 1986

[54] FEED GUIDE STOPS FOR POSITIONING SHEET PRODUCTS

[76] Inventors: Jean P. Cuir, 36 avenue de Brigode; Gérard Cuir, 23 Allee des Champs, both of 59650 Villeneuve d'Ascq, France

[21] Appl. No.: 501,826

[22] Filed: Jun. 7, 1983

[30] Foreign Application Priority Data

Jun. 7, 1982 [FR] France ..... 82 10273

[51] Int. Cl.[4] ..... B65H 31/36

[52] U.S. Cl. ..... 271/236; 271/224; 271/253

[58] Field of Search ..... 271/226, 236, 220, 237, 271/223, 238, 224, 239, 240, 253

[56] References Cited

U.S. PATENT DOCUMENTS

| | | | |
|---|---|---|---|
| 1,067,475 | 7/1913 | Engel | 271/224 |
| 2,626,800 | 1/1953 | Martin | 271/224 |
| 3,022,999 | 2/1962 | Mead | 271/224 |
| 3,408,140 | 10/1968 | Hemphill | 271/238 |
| 3,662,635 | 5/1972 | Yabuta | 271/236 |
| 3,693,970 | 9/1972 | Grobman | 271/240 |
| 3,997,154 | 12/1976 | Mol | 271/224 |
| 4,052,054 | 10/1977 | Cardwell et al. | 271/238 |
| 4,341,299 | 7/1982 | Walker et al. | 271/236 |

FOREIGN PATENT DOCUMENTS

| | | | |
|---|---|---|---|
| 138847 | 12/1901 | Fed. Rep. of Germany | 271/226 |
| 1512679 | 10/1924 | United Kingdom . | |

OTHER PUBLICATIONS

IBM Technical Disclosure Bulletin, vol. 19, No. 9, Feb. 1977, W. E. Allen et al, "Aligning Paper Tray".

*Primary Examiner*—Bruce H. Stoner, Jr.
*Assistant Examiner*—James E. Barlow
*Attorney, Agent, or Firm*—Kerkam, Stowell, Kondracki & Clarke

[57] ABSTRACT

The invention relates to a guide stop for positioning sheet products. It is characterized by the fact that the stop guide is made up of a series of thin strips (9, 10) which, on the one hand, are substantially parallel to each other and, on the other, normal both to the plane P of the sheet (6) and to the corresponding edge (4 or 5) of said sheet (6) which the stop guide (2 or 3) is to position. The invention is used for positioning sheets of paper or cardboard in feed tables, printing or cutting presses or stacking machines.

12 Claims, 3 Drawing Figures

FIG. 1
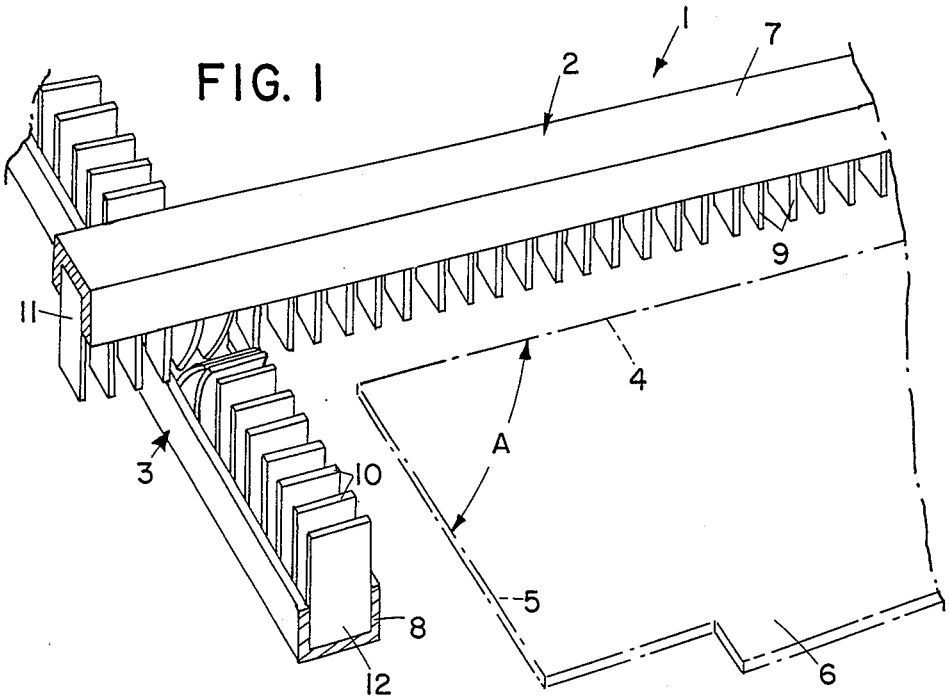
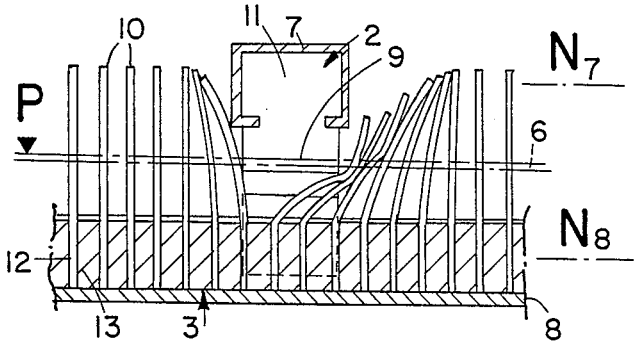
FIG. 2
FIG. 3
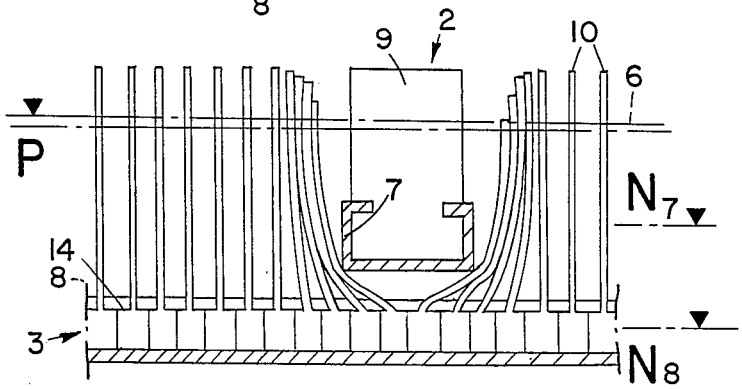

FEED GUIDE STOPS FOR POSITIONING SHEET PRODUCTS

BACKGROUND OF THE INVENTION

1. Field of the Invention

The invention relates to feed guide stops for positioning sheet products and to the assembly provided with such feed guide stops.

2. Description of the Prior Art

The invention relates more particularly, but not exclusively, to feed guide stops, for positioning sheets of paper or cardboard in printing machines. Such stops may be found on feed tables for a printing and/or cutting press or devices for stacking sheets exiting from this press.

In these assemblies, it is common practice, as described for example in French Pat. Nos. A 2,277,727 and 2,308,576, to fix edgewise in their frame guide stops against which the sheets come to a stop, depending upon the type of assembly considered, prior to being taken and carried to the press and/or to complete their being placed in the stack.

It stands to reason that these guide stops all act in a common plane corresponding to that of the sheet to be positioned and in which plane they each follow one of the edges of said sheet which, for example, if it is rectangular, will thus call upon front and side guide stops. Needless to say that in order to be able to adapt to the different formats likely to be used in at least one of the machines placed downstream and/or upstream of the positioning assembly, while continuing to act in the same plane, it must be possible to position these guide stops in the frame of said assembly in accordance with the formats used.

To accomplish end positioning, the front and side guide stops are usually connected to front and side supports which, advantageously, are placed in the assembly at different levels so as to be able to fix them in the frame without interfering with one another. When fixing such supports in the frame, one can call upon known fixing means which are known in the art, such as clamps or sliding blocks, each of which cooperate with one of the positionable slide bars or guide rods carried by the frame and which are controlled separately, for example, by flywheels which set in motion nut/bolt or rack-pinion systems under the possible control of a vernier. In order to freely intersect at different coordinates dictated by the different formats of the sheets, the supports can be placed at different levels. The same, however, does not hold true for guide stops which, as already mentioned above, necessarily must all act in the same plane. Because of this operational requirement, in prior art structures which utilize guide stops, the guide stops cannot intersect. At each point of intersection, movement or operation of at least one of them must thus be interrupted locally in order to let the other pass. Thus, for each of the formats, at least one of the guide stops must be specially constructed.

Needless to say, this results in a cost increase for the necessary components of the machine and in an increase in the time lost for preparing machines to a new format, because of the need to disassemble the old guide stop and fix the new one in place.

SUMMARY OF THE INVENTION

One feature of the invention is to provide a set of of feed guide stops which, while acting in a common plane, can intersect at different places without requiring a special assembly in the machine.

With this in mind, one object of the invention is a guide stop of the type mentioned hereinabove, which is characterized in that it is composed of a series of thin strips which are substantially parallel to one another and are normal both to the plane of the sheet and to the edge of said sheet that this guide stop is to position.

BRIEF DESCRIPTION OF THE DRAWING

The invention will be better understood from a consideration of the ensuing description given by way of non-limitative example, reference being had to the accompanying schematic drawing, wherein:

FIG. 1 is a perspective view of a set of guide stops according to the invention;

FIG. 2 is a section through the axis of one of the guide stops according to the invention; and FIG. 3 is a variant form of the assembly.

DESCRIPTION OF THE PREFERRED EMBODIMENTS

Now, referring to the drawing, it is apparent that the assembly 1 comprises at least two guide stops 2, 3 which follow two sides 4, 5, adjacent to a common angle "A", of a sheet 6 of paper or board located in a plane P.

These guide stops include, e.g., a front guide 2 and a side guide 3, depending on whether they follow the front side of the lateral side of the sheet. Thus, the terms front and side are relative locational terms. The stops 2, 3 are connected to supports 7, 8 called, respectively, the front support and side support, which are fixed in the frame (not shown) of the assembly in a manner well known in the art at different levels $N_7$, $N_8$ so that they can be adjusted in position without interfering with one another. The guide stops 2, 3 which extend from their supports both have at least one part of their heights extending necessarily to at least the height of the plane P of the sheet 6.

According to one essential feature of the invention, at least one of the guide stops 2, 3 consists of a series of thin strips 9, 10 extending from its support and arranged substantially parallel to one another and normal both to the plane P of the sheet and to the edge of said sheet which is to be positioned by this guide. When the edge of a sheet is received against the strips, the thin strips 9, 10, are stressed in a direction parallel to their plane and resist flexure, thus forming an excellent stop.

On the other hand, if during the format adjustment they are stressed by the other guide stop in a direction parallel to the sheet edge they position, i.e. along the axis of the support, the thin strips can bend effortlessly to accommodate the support and then come back elastically in a good position as soon as the stressing disappears upon removal of the support.

This permits the support of the guide stops that positions one side adjacent to the same angle to move parallel to the edge of the first guide stop considered from one position to another without requiring fixing or disassembly of guide stops even though the strips may be engaged. The stops are thus always ready for use.

The supports 2 and 3 thusly combined can support their thin strips on their surfaces with the strips facing each other or extending in opposite directions as shown in FIG. 2 between which the plane P of the sheet is situated, as well as on two surfaces turned in the same direction as shown in FIG. 3 where the strips extend from their supports in the same direction. In order to reach the plane P which lies above or below the two supports, the thin strips 10 of one of the guide stops 8 can be longer than those (9) of the other guide stop 7. One (2) of the guide stops 2, 3 and especially in the case illustrated in FIG. 3, the guide stop whose support 7 is the closest to the plane P of the sheet, may be of the conventional type and can pass within the thin strips of the support 8 of the other guide stop which, in this example, is the guide stop which is remote from the plane P of the sheet 6.

The support 7, 8 can have the form of a structural section which houses the feet 11, 12 of the thin strips, which feet, in order to maintain the parts of the thin strips forming the stop at a suitable distance, can eithe have a greater thickness (as shown at 14 in FIG. 3) than the rest of the thin strip, or they can receive wedges 13 which maintain them spaced.

The thin strips will be made from an elastic material which is chosen after taking into account the nature of the sheets positioned and are made, for example, from strip spring steel or from a semi-rigid plastic material, such as polyamide or polyethylene. It goes without saying that the supports can intersect at angles other than 90 degrees.

We claim:

1. A guide stop assembly for positioning a sheet (6) being fed into or out of a machine, the assembly comprising first and second guide stops (2, 3) against which first and second intersecting side edges (4, 5) of the sheet to be positioned respectively come to rest either prior to the sheet being fed to the machine or after the sheet is fed out of the machine, said guide stops both being arranged to act in a plane corresponding to that of the sheet and in which plane said guide stops each positions a respective one of the first and second side edges (4, 5) of said sheet; and first and second support means (7, 8) for carrying said first and second guide stops, respectively, said first and second support means being disposed at different levels relative to the plane to enable the first and second support means to extend parallel to the first and second intersecting side edges, respectively, and to cross each other without interference, each of said guide stops including a succession of thin planar flexible strips arranged on a corresponding one of the support means with the principal planar surfaces of the strips substantially parallel to each other and normal both to the plane of the sheet and to the adjacent side edge (4, 5) of said sheet (6) which said guide stop positions, the first and second support means crossing each other without interference by each support means causing the flexible strips of the other support means to bend so that each support means passes between adjacent bent strips of the other support means.

2. The guide stop assembly according to claim 1, wherein said thin strips (9, 10) each have a foot portion affixed to the corresponding support means, and have another portion forming a positioning stop for the sheet, said strips having at their foot portions (11, 12) a greater thickness than at their other portions forming the positioning stop such that the other portions are spaced apart.

3. The guide stop assembly according to claim 1, wherein the thin strips have foot portions and stop portions, and between the foot portions (11, 12) of the thin strips there are inserted wedges (13, 14) which maintain the stop portions of adjacent thin strips spaced.

4. The guide stop assembly according to claim 1, wherein the thin strips are made from elastic material.

5. A sheet-positioning assembly comprising a pair of guide stops for positioning respective edges of a sheet, which edges define a common angle which is other than a straight angle, and a pair of elongated support means for respectively positioning said guide stops to engage said respective edges which the guide stops position, each of said guide stops including a plurality of spaced thin planar flexible strips extending from a corresponding one of said support means with said strips being arranged with the principal planar surfaces thereof substantially parallel to each other and normal both to a plane of the sheet and to the respective edge of the sheet which said guide stop positions, and the support means being located at different heights and crossing each other by one support means causing the strips of the other support means to bend so that said one support means passes between adjacent bent strips of the other support means.

6. The assembly according to claim 4, wherein the first support means is located beneath the plane of the sheet and the second support means is located above said plane, said support means supporting said thin strips so that the thin strips extend on opposite sides of the plane.

7. The assembly according to claim 5, wherein both support means are situated on the same side of the plane of the sheet, and the thin strips extend from the support means on opposite sides of said plane.

8. The assembly according to claim 5, wherein the guide stops each have a longitudinal axis, and at least one of said guide stops is movable in a direction normal to the longitudinal axis of the other guide stop.

9. The assembly according to claim 5, wherein said guide stops each have a longitudinal axis and are each movable in a direction normal to the longitudinal axis of the other guide stop and such that the guide stops cross each other.

10. The assembly according to claim 1, wherein said first and second guide stops each have a longitudinal axis and are movable normal to the longitudinal axis of the other guide stop.

11. The assembly of claim 5, wherein each guide stop is movable in a direction normal to the respective edge of the sheet which the guide stop positions.

12. A positioning assembly for a sheet comprising first and second elongated support members, each support member having a plurality of spaced thin planar strips of flexible material extending therefrom, the strips extending from each support member being arranged with their planar surfaces parallel and with said surfaces normal to a longitudinal axis of the support member, each support member being movable in a direction normal to its longitudinal axis, and the first and second support members being arranged with their longitudinal axes parallel to intersecting edges of a sheet to be positioned with the thin strips extending from each support member extending on opposite sides of a plane containing the sheet, the first and second support members being disposed at different levels and arranged to cross each other with the strips of the first and second support members engaging one another and bending such that one support member can pass between the bent strips of the other support member.

* * * * *